US006676543B2

(12) United States Patent
Endo

(10) Patent No.: US 6,676,543 B2
(45) Date of Patent: Jan. 13, 2004

(54) COATED GOLF BALL

(75) Inventor: Seiichiro Endo, Kobe (JP)

(73) Assignee: Sumitomo Rubber Industries, Limited, Hyogo (JP)

( * ) Notice: Subject to any disclaimer, the term of this patent is extended or adjusted under 35 U.S.C. 154(b) by 31 days.

(21) Appl. No.: 09/974,875

(22) Filed: Oct. 12, 2001

(65) Prior Publication Data

US 2002/0077197 A1 Jun. 20, 2002

(30) Foreign Application Priority Data

Oct. 25, 2000 (JP) ..... 2000-325838

(51) Int. Cl.[7] ..... A63B 37/06
(52) U.S. Cl. ..... 473/378
(58) Field of Search ..... 473/351, 378

(56) References Cited

U.S. PATENT DOCUMENTS 4,679,794 A * 7/1987 Yamada et al. ..... 473/385
4,798,386 A * 1/1989 Berard ..... 473/374
4,802,674 A * 2/1989 Kitaoh ..... 473/373
4,865,326 A * 9/1989 Isaac et al. ..... 473/374
4,998,734 A * 3/1991 Meyer ..... 473/356
5,000,458 A * 3/1991 Proudfit ..... 473/376
5,018,742 A * 5/1991 Isaac et al. ..... 473/378
5,494,291 A * 2/1996 Kennedy ..... 473/378
5,540,438 A * 7/1996 Horiuchi et al. ..... 473/376
5,542,680 A * 8/1996 Proudfit et al. ..... 473/378
6,022,279 A * 2/2000 Yamagishi et al. ..... 473/353

FOREIGN PATENT DOCUMENTS

EP A1 0 562 882 3/1993

* cited by examiner

*Primary Examiner*—Mark S. Graham
*Assistant Examiner*—Raeann Gorden
(74) *Attorney, Agent, or Firm*—Birch, Stewart, Kolasch & Birch, LLP

(57) ABSTRACT

A coated golf ball is provided of which possible flaw or paint peeling caused by shots does not become conspicuous even after it has been left outdoors for a long time. The coated golf ball comprises a ball body having a surface layer containing a white pigment and essentially free of a fluorescent brightener and an ultraviolet absorber, and a paint layer containing the fluorescent brightener and the ultraviolet absorber. The ball body as well as the coated golf ball has a color tone represented by CIE L*a*b* color system: $88 \leqq L^* \leqq 93$, $-2 \leqq a^* \leqq 2$, and $-12 \leqq b^* \leqq -5$. Differences in "L*", "a*" and "b*" values between the color tone of the ball body and one of the coated golf ball are not more than 2, not more than 3, and not more than 3, respectively.

4 Claims, 1 Drawing Sheet

COATED GOLF BALL

BACKGROUND OF THE INVENTION

1. Field of the Invention

The present invention relates to a coated golf ball that makes inconspicuous such possible defects as flaw or peeling of a paint layer formed over the surface of its ball body not only at its brand-new stage but also after it has been left outdoors for a long time.

2. Description of the Related Art

General golf balls are coated with a clear paint or a paint of a similar color of the ball body so as to be made glossy. When such a coated golf ball is hit with a short iron or a sand wedge, the ball surface of the coated golf ball is flawed with the grooved face of the short iron or the sand wedge, sometimes resulting in peeling of the paint layer.

In order to make a peeled portion of such a paint layer inconspicuous, the color tone of the paint layer has been made analogous to that of the ball body surface. Japanese Patent Laid-Open Gazette No. HEI 5-269220 (Japanese Patent No. 3027050), for instance, discloses a golf ball wherein the ranges of whiteness (Wcie) and greenishness (Tw) of the coated golf ball are specified, while differences in whiteness (Wcie) and greenishness (Tw) between the cover and the coated golf ball are specified.

Such a coated golf ball, however, is subject to color change at its paint layer and ball body if the coated ball is stored for a long time or under a high-temperature condition or if the coated ball is left outdoors for a long time. For this reason, even if the whitenesses of the ball body and the coated ball in a brand-new state (in an early stage) are adjusted, a difference in color between them will develop with time. Particularly where the paint layer is sharply flawed by a club with a greater deal of loft such as a sand wedge, the difference between the color tone on the surface of the ball body and one on the surface of the paint layer formed over the ball body, namely the flaw, becomes conspicuous.

SUMMARY OF THE INVENTION

An object of the present invention is to provide a coated golf ball which is capable of making its flaw or paint peeling inconspicuous, which is likely to occur due to shots, even after it has been left outdoors for a long time.

A coated golf ball of the present invention comprises a ball body and at least one colorless, transparent paint layer covering the ball body. The ball body has a surface layer containing a white pigment and essentially free of a fluorescent brightener and an ultraviolet absorber. The paint layer contains a fluorescent brightener and an ultraviolet absorber. The color tone represented by CIE L*a*b* color system on a surface of the ball body satisfies the following requirement: L* being in the range of 88 to 93, a* being in the range of −2 to 2, and b* being in the range of −12 to −5. The color tone represented by CIE L*a*b* color system on a surface of the paint layer formed over the surface of the ball body satisfies the following requirement: L* being in the range of 88 to 93, a* being in the range of −2 to 2, and b* being in the range of −12 to −5. CIE L*a*b* color difference between the color tone on the surface of the ball body and the color tone on the surface of the paint layer satisfies the following requirement: a difference (ΔL) in the L* being at least 2, a difference (Δa) in the a* being at least 3, and a difference (Δb) in the b* being at least 3.

The foregoing and other objects, features and attendant advantages of the present invention will become apparent from the reading of the following detailed description.

DETAILED DESCRIPTION OF THE PREFERRED EMBODIMENTS

Figure 1:
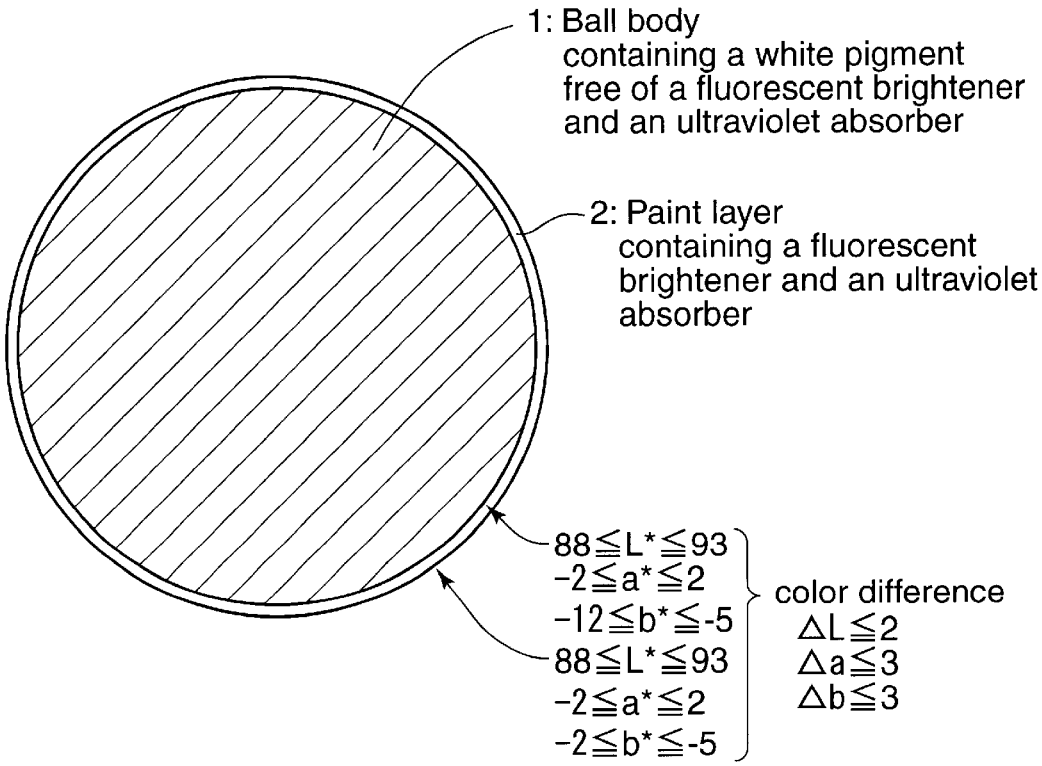
FIG. 1 is a schematic view showing the appearance of a coated golf ball according to the present invention.

As shown in FIG. 1, the coated golf ball of the present invention comprises a ball body 1 and at least one colorless, transparent paint layer 2 covering the ball body 1. A surface layer of the ball body 1 contains a white pigment and essentially free of a fluorescent brightener and an ultraviolet absorber, and satisfies the color tone represented by CIE L*a*b* color system: $88 \leqq L^* \leqq 93$, $-2 \leqq a^* \leqq 2$, and $-12 \leqq b^* \leqq -5$. The paint layer 2 contains the fluorescent brightener and the ultraviolet absorber. The color tone represented by CIE L*a*b* color system on a surface of the paint layer formed over the surface of the ball body satisfies: $88 \leqq L^* \leqq 93$, $-2 \leqq a^* \leqq 2$, and $-12 \leqq b^* \leqq -5$. CIE L*a*b* color difference between the color on the surface of the ball body and the color on the surface of the paint layer satisfies: a difference in L* value $(\Delta L) \leqq 2$, a difference in a* value $(\Delta a) \leqq 3$, and a difference in b* value $(\Delta b) \leqq 3$.

In the coated golf ball of the present invention, the ball body shows a bright white color and is coated with the colorless, transparent paint layer that allows the color of the ball body to be shown substantially as it is. If such a coated golf ball is flawed in a brand-new state by shots with golf clubs, the flaw might not be inconspicuous. Furthermore, in such a coated golf ball, the ball body as well as the clear paint layer is prevented from deteriorating bright whiteness due to ultraviolet ray, ozone or the like, and hence the coated golf ball keeps on showing the bright white color that is shown by the ball body in its early stage. Therefore, according to the inventive coated golf ball, flaw caused by shots with golf clubs can be made inconspicuous even after the ball has been left outdoors for a long time.

The ball body used in the present invention, or a golf ball without the paint layer, may be a one-piece golf ball body, a multi-piece golf ball body comprising a core and a cover, or a wound-core golf ball body comprising a core wound by rubber thread and a cover covering the core. The term "surface layer of the ball body", as used herein, means a one-piece golf ball body in its entirety if the ball body is the one-piece golf ball body, or a cover forming the outermost layer of a multi-piece or wound-core golf ball body if the ball body is the multi-piece golf ball body or the wound-core golf ball body. The surface layer of the ball body is formed from a resin or rubber containing a white pigment and essentially free of a fluorescent brightener and an ultraviolet absorber, or a mixture of the resin and the rubber, and shows a color tone represented by CIE L*a*b* color system falling in the specific ranges.

The CIE L*a*b* color system is prescribed by JIS Z8729, wherein "L*" represents lightness (what is called "whiteness"), and "a*" and "b*" each represent a chromaticity (what is called a "shade") indicative of a hue and a chroma. The values of "L*", "a*" and "b*" can be found from the following formulae using tristimulus lines X, Y and Z prescribed by JIS Z8701 or JIS Z8782.

$$L=116\times(Y/Yn)^{1/3}-16$$

$$a=500\times[(X/Xn)^{1/3}-(Y/Yn)^{1/3}]$$

$$b=200\times[(Y/Yn)^{1/3}-(Z/Zn)^{1/3}]$$

In the above formulae, Xn, Yn and Zn are tristimulus values in the XYZ standard calorimetric system of a perfect diffuse reflection surface, and Y/Yn, X/Xn and Z/Zn are each larger than 0.008856.

The "L*" value of the color tone on a surface of the ball body (hereinafter referred to as "L*(body)" value) is not less than 88 and not more than 93, preferably not less than 88.5 and not more than 92.5, more preferably not less than 89 and not more than 92. If the "L*(body)" value is less than 88, the color on a surface of the ball body is dark and hence is not preferable in terms of appearance. Though a larger "L*" value is more preferable, it is possible to limit the "L*" value to 93 or less, preferably 92.5 or less in view of the limitations essential to the characteristics of the materials used.

The "a*" value of the color tone on a surface of the ball body (hereinafter referred to as "a*(body)" value) is not less than −2 and not more than 2, preferably not less than −1.5 and not more than 1.5, more preferably not less than −1 and not more than 1. If the "a*(body)" value is less than −2, the ball body has a color tone with too strong greenishness, while if it is more than 2, the ball body has a color tone with too strong reddishness. In either case, the whiteness of the ball is lower than required of the appearance of a white-colored golf ball, resulting in the golf ball having an unfavorable appearance.

The "b*" value of the color tone on a surface of the ball body (hereinafter referred to as "b*(body)" value) is not less than −12 and not more than −5, preferably not less than −11.5 and not more than −5.5, more preferably not less than −11. If the "b*(body)" value is less than −12, the ball body has a color tone with too strong bluishness, while if it is more than −5, the ball body has a color tone with too strong yellowishness. In either case, the whiteness of the ball is lower than required of the appearance of a white-colored golf ball, resulting in the golf ball having an unfavorable appearance.

Examples of suitable rubbers for forming the ball body include rubbers known in the art of golf balls such as isoprene rubber, butyl rubber and natural rubber. Examples of preferable resins for forming the ball body include ionomers, urethane resins, olefin resins, elastomers, styrene resins, epoxy resins, and mixtures thereof.

An inorganic pigment such as zinc oxide, barium sulfate, titanium oxide or calcium oxide is used as the white pigment in the present invention. It is possible to appropriately blend a blue pigment, green pigment, red pigment or the like in addition to such a white pigment to impart vividness to the color of the ball body as long as the color tone of the ball body has "L*", "a*" and "b*" values assuming 88 to 93, −2 to 2, and −12 to −5 respectively.

The total amount of such pigments is appropriately selected so that the color tone of the ball body meets the aforementioned requirements. Specifically, the total amount of pigments used is preferably 0.2 to 15 parts by mass based on 100 parts by mass of the resin.

The ball body according to the present invention is essentially free of a fluorescent brightener and an ultraviolet absorber. The expression "essentially free of a fluorescent brightener and an ultraviolet absorber", as used herein, means that the ball body may contain a trace amount of a fluorescent brighter or an ultraviolet absorber but does not contain them in an amount sufficient to fulfill their functions.

The present invention requires that the ball body be essentially free of a fluorescent brightener because the fluorescent brightener in combination with the white pigment contained in the ball body is subject to color change when exposed to light, ozone and the like. Further, use of the fluorescent brightener in an amount such as to provide a sufficient brightening effect may lower the strength of the surface layer of the ball body, not to mention increasing the manufacturing cost. Another reason is that the fluorescent brightener contained in the paint layer covering the ball body is sufficient to provide a bright white color that meets the appearance requirement of the golf ball. As to the ultraviolet absorber, if it is contained in the clear paint layer which ultraviolet ray transmits, the absorber effectively absorbs ultraviolet ray thereby reducing the amount of ultraviolet ray reaching the ball body, with the result that lowering whiteness of the ball body can be prevented. If the ultraviolet absorber is contained in the ball body, however, it needs to be used in a large amount in order to provide a satisfactory effect in suppressing lowering of whiteness. Use of the ultraviolet absorber in such a large amount may increase the manufacturing cost and lower the strength of the surface layer of the ball body. For this reason, the use of the ultraviolet absorber in the golf ball body is not preferable.

It is to be noted that the material forming the surface layer of the ball body may optionally contain a light stabilizer and an antioxidant to prevent the resin or rubber used therein from deteriorating on condition that the "L*", "a*" and "b*" values fall within respective ranges specified by the present invention.

To enhance the adhesion between the ball body and the paint layer, it is preferred that the surface of the ball body be subjected to any one of a chlorine treatment, a plasma treatment and a flaming treatment.

The coated golf ball of the present invention comprises the ball body described above and at least one colorless, transparent paint layer covering the surface of the ball body. Preferably, the color tone of the coated golf ball represented by CIE L*a*b* color system is substantially the same as the color tone of the ball body or meets the following specific requirements.

The "L*" value of the color tone in a state in which the ball body is coated with the paint layer, namely the coated golf ball, which will hereinafter be referred to as "L*(after coating)" value, is not less than 88 and not more than 93, preferably not less than 88.5 and not more than 92.5, more preferably not less than 89 and not more than 92. The "a*" value of the color tone on the surface of the coated golf ball (hereinafter referred to as "a*(after coating)" value) is not less than −2 and not more than 2, preferably not less than −1.5 and not more than 1.5, more preferably not less than −1 and not more than 1. The "b*" value of the color tone on the surface of the coated golf ball (hereinafter referred to as "b*(after coating)"" value) is not less than −12 and not more than −5, preferably not less than −11.5 and not more than −5.5, more preferably not less than −11.

Further, the difference (ΔL) between the "L*(body)" value and the "L*(after coating)" value is preferably not more than 2 ($\Delta L \leqq 2$), the difference (Δa) between the "a*(body)" value and the "a*(after coating)" value is preferably not more than 3 ($\Delta a \leqq 3$), and the difference (Δb) between the "b*(body)" value and the "b*(after coating)" value is preferably not more than 3 ($\Delta b \leqq 3$).

By thus adjusting the color tone after paint coating, namely the color tone on the surface of the paint layer formed over the ball body, so as to be substantially the same as the color tone before paint coating, namely the color tone on a surface of the ball body, sharp flaw or partial peeling of the paint layer caused by such flaw will not become conspicuous.

The paint forming the paint layer according to the present invention may be of the urethane type, epoxy type or acrylic type and contains a fluorescent brightener and an ultraviolet absorber but does not contain any pigment.

The paint layer not containing any pigment allows the color of the ball body to be shown. More specifically, by making the paint layer colorless and transparent, (1) it is possible to keep the bright white color of the ball body even after coating, if the color tone of the ball body is bright white; and (2) color change of the paint layer hardly occurs even if the ball is left as exposed to sunlight for a long time. Thus, the coated golf ball allows the color of the ball body to be shown over a long period of time from its brand-new stage to the end of prolonged storage. For this reason, even when the golf ball having experienced such prolonged storage is flawed by shots with golf clubs so that its paint layer is partially peeled thereby, the flaw does not become conspicuous by virtue of little difference in color tone between the states with and without the paint layer.

The fluorescent brightener serves to absorb light in the ultraviolet region and convert it into visible light (blue). Even when the fluorescent brightener is added to the paint layer only, it can give the whiteness of the coated golf ball brightner. In the case where the fluorescent brightener is contained in a cover or one-piece golf ball body, which is equivalent to the surface layer of the ball body, it is generally required that a large amount of fluorescent brightener be used in proportion to the volume of the surface layer of the ball body. In contrast, the use of the fluorescent brightener in a thin paint layer only can provide a satisfactory brightening effect if the amount of the fluorescent brightener is not so large as to raise the problem of color change of the fluorescent brightener.

Examples of specific fluorescent brighteners include "Ubitex O.B" (a butyl-benzoxazole derivative chemically known as 2,5-bis(5-tert-butyl-2-benzoxazolyl)thiophene) available from Ciba-Geigy Co., "whiteflour PCS" available from Sumitomo Chemical Co., Ltd., "Hoslaluv KCB" available from Hoechst Japan Co., and "Leucopur EGM" available from Sandz Co. The content of the fluorescent brightener has to be an amount such as not to cause conspicuous color change. Specifically, the content of the fluorescent brightener is preferably 0.005 to 3 parts by mass, more preferably 0.005 to 2 parts by mass based on 100 parts by mass of the paint layer forming component (i.e. resin content). If it is less than 0.005 parts by mass, a satisfactory brightening effect does not result. If it is more than 3 parts by mass, the brightening effect is saturated despite an increase in the manufacturing cost. Further, since the fluorescent brightener, per se, is subject to color change during long-term use of the ball, use of the brightener in an excessive amount is not preferable. Moreover, use of the fluorescent brightener in an amount of more than 3 parts by mass makes the coated golf ball surface somewhat rough thereby lowering the quality of the ball.

The ultraviolet absorber prevents the paint layer from deteriorating due to ultraviolet ray by absorbing ultraviolet ray, while contributing to preventing deterioration of the rubber or resin forming the surface layer of the ball body by reducing the dose of ultraviolet ray reaching the ball body. If the ultraviolet absorber is contained in the surface layer of the ball body, the amount of the ultraviolet absorber needs to be considerably large. Use of the ultraviolet absorber in such a large amount brings a disadvantage in terms of price while causing color change of the coated ball left outdoors for a long time in cooperation with the white pigment contained in the surface layer of the ball body.

Ultraviolet absorbers for use in the present invention are those which can absorb ultraviolet rays of 300 to 400 nm known to be particularly harmful. Such ultraviolet absorbers are, for example, salicyclic acid derivatives, benzophenones, benzotriazoles, cyanoacrylate-type compounds, and nickel complexes. Examples of specific salicyclic acid derivatives include phenyl salicylate, p-t-butylphenyl salicylate, and p-octylphenyl salicylate. Examples of specific benzophenones include 2,4-dihydroxybenzophenone, 2-hydroxy-4-methoxybenzophenone, 2-hydroxy-4-octoxybenzophenone, and 2,2-dihydroxy-4,4'-methoxybenzophenone. Examples of specific benzotriazoles include, but not limited to, 2-(2'-hydroxy-5'-methylphenyl)benzotriazole, 2-(2'-hydroxy-5'-t-butylphenyl)benzotriazole, and 2-(2-hydroxy-3'-t-butyl-5'-methylphenyl)-5-chlorobenzotriazole. Examples of specific cyanoacrylate-type compounds include, but not limited to, 2-ethylhexyl-2-cyano-3,3-diphenyl acrylate, and ethyl-2-cyano-3,3'-diphenyl acrylate. Specific commercially-available ultraviolet absorbers include "SUMISORB 130" and "SUMISORB 140" available from Sumitomo Chemical Co., Ltd. as benzophenones; "Tinuvin 900", "Tinuvin 326", and "Tinuvin P" available from Ciba-Geigy Co. as benzotriazoles; and "Uvinul N-35" available from BASF CO. as cyanoacrylate-type compounds.

The paint layer is preferably free of any light stabilizer. This is because the light stabilizer greatly influences the color tone on a surface of the paint layer formed of the ball body and hence makes the color tone of the coated ball difficult to show the color tone of the ball body even if the paint layer is colorless and transparent. Thus, it is sometimes difficult to adjust the color tone on the surface of the paint layer formed over the ball body and the difference between the color tone on the surface of the ball body and one on the surface of the paint layer formed over the ball body so as to fall within respective ranges specified by the present invention.

The paint layer is formed by applying a paint material having the above-mentioned composition onto the ball body surface. The paint layer may be of a multi-layered structure comprising at least two layers. In the case of such a multi-layered paint layer, all the layers forming the paint layer are met the foregoing requirements. The thickness of the paint layer should be to such an extent that color change of the fluorescent brightener contained in the paint layer does not become problematic. The thickness of the paint layer is preferably 5 to 100 $\mu$m in total, more preferably 5 to 50 $\mu$m in total.

The coated golf ball of the present invention is coated with the above-mentioned paint layer and shows the color tone (adjusted to bright white) of the surface layer of the ball body as it is even after coating with the clear paint. Even if the paint layer of the coated golf ball is partially peeled off when the ball is flawed with a short iron or the like after the ball has been left outdoors for a long time, such a flawed portion does not become conspicuous because the color tone of the ball body is shown.

EXAMPLES

Measurement and Evaluation Methods

1. Color Tone

The "L*", "a*" and "b*" values of a color tone were measured using a colorimeter ("CR-221" manufactured by Minolta Co.).

2. Appearance

Each coated golf ball held by hand was visually observed to check its color tone. A golf ball judged to show a bright white color was indicated by a sign "○", while a golf ball judged to show a subdued white color was indicated by a sign "x".

3. Weatherability Test

Each coated golf ball was exposed to UV radiation for 240 hours using "SUNSHINE WEATHERMETER (WEL-SUN-HC·B Model)" manufactured by Suga Shikenki Co. under the conditions: chamber temperature=63° C., humidity=50%, and 12 minutes' rainfall per 60 minutes, and then visually observed to check the degree of color change after exposure to UV radiation. A golf ball with a considerable color change was indicated by a sign "x", while a golf ball with little color change indicated by a sign "○".

4. Flaw Conspicuousness i) Early Stage

Each coated golf ball having just been manufactured was actually hit by a professional golfer using a sand wedge (at a head speed of about 30 m/s). Thereafter, each golf ball was held by hand and visually observed to check its appearance. A golf ball with flaw judged inconspicuous was indicated by a sign "○", while a golf ball with flaw judged perceptible was indicated by a sign "x".

ii) Stage After Weathering

Each coated golf ball was exposed to UV radiation for 120 hours using "SUNSHINE WEATHERMETER (WEL-SUN-HC·B Model)" manufactured by Suga Shikenki Co. under the conditions: chamber temperature=63° C., humidity=50%, and 12 minutes' rainfall per 60 minutes. After the exposure to UV radiation, each coated golf ball was actually hit in the same manner as above. Thereafter, each golf ball was held by hand and visually observed to check its appearance. A golf ball with flaw judged inconspicuous was indicated by a sign "○", while a golf ball with flaw judged perceptible was indicated by a sign "x".

Manufacture of Golf Ball

1. Manufacture of Ball Body

Each ball body was manufactured by injection-molding each composition shown in Table 1 onto a rubber core to form a cover, followed by abrading the resulting parting line. The color tone of the ball body was measured. The results of the measurement are shown in Table 1.

The cover A was free of a fluorescent and an ultraviolet absorber and showed a color tone having "L*(body)", "a*(body)" and "b*(body)" values within respective ranges specified by the present invention.

TABLE 1

| Cover | A | B | C | D | E |
|---|---|---|---|---|---|
| Ionomer resin | 100 | 100 | 100 | 100 | 100 |
| Titanium dioxide | 3 | 3 | 3 | 3 | 3 |
| Barium oxide | 1 | 1 | 1 | 1 | 1 |

TABLE 1-continued

| Cover | A | B | C | D | E |
|---|---|---|---|---|---|
| Light stabilizer | 0.2 | 0.2 | 0.2 | 0.2 | 0.2 |
| Blue pigment | 0.05 | 0.05 | — | 0.5 | 0.05 |
| Red pigment | — | 0.05 | 0.05 | — | — |
| Fluorescent brightener | — | — | — | — | 0.2 |
| Ultraviolet absorber | — | — | — | — | 0.2 |
| Color tone | | | | | |
| L *(body) | 90.5 | 87.8 | 88.6 | 86.0 | 91.0 |
| a *(body) | −0.5 | 5.0 | 3.0 | −2.3 | −0.5 |
| b *(body) | −7.0 | −5.5 | −2.0 | −15.0 | −7.0 |

In Table 1, the ionomer resin was a mixture of "Himilan 1605" and "Himilan 1705" available from Mitsui-DuPont Co., Ltd (mixing ratio=1:1); the light stabilizer was "SANOL L770" available from Sankyo Co.; the blue pigment was "Ultramarine Blue" available from Daiichikasei Co. Ltd., while the red pigment was "Supermagenta R" available from Dainippon Ink & Chemicals.; and the fluorescent brightener was "UBITEX-OB" available from Ciba-Geigy Co., while the ultraviolet absorber was "Uvinul N-35" available from Ciba-Geigy Co.

2. Formation of Paint Layer

Each paint layer shown in Table 2 was formed on the surface of each ball body to complete each of coated golf balls Nos. 1 to 10.

Coated golf balls Nos. 1 to 7, 9 and 10 were each coated with a first paint only and hence had a single clear paint layer, whereas coated golf ball No. 8 was coated with a first paint and then with a second paint and hence had two clear paint layers.

Each coated golf ball thus manufactured was visually observed as to its color tone and appearance to check its color fastness to weathering and its flaw conspicuousness. The results of the observation are shown in Table 3.

It is to be noted that coated golf balls Nos. 1 and 2 each having cover and clear paint layer satisfying the requirements of the present invention and having a difference in color tone between the states before coating (i.e. ball body) and after coating (i.e. coated golf ball) that fell within the range specified by the present invention fall under the category of example of the present invention, whereas other golf balls fall under the category of comparative example.

In Table 2, the fluorescent brightener was "UBITEX-OB" available from Ciba-Geigy Co., while the ultraviolet absorber was "Uvinul N-35" available from Ciba-Geigy Co.; and the light stabilizer was "SANOL L770" available from SANKYO CO.

TABLE 2

| Coated golf ball No. | 1 | 2 | 3 | 4 | 5 | 6 | 7 | 8 | 9 | 10 |
|---|---|---|---|---|---|---|---|---|---|---|
| Cover | A | A | B | C | D | E | A | A | A | A |
| First paint layer | | | | | | | | | | |
| Resin | urethane | acrylic | urethane | urethane | urethane | urethane | urethane | urethane | urethane | urethane |
| Fluorescent brightener | 0.2 | 0.2 | 0.2 | 0.2 | 0.2 | 0.2 | 0.2 | 0.2 | 0 | 0.2 |
| Titanium oxide | 0 | 0 | 0 | 0 | 0 | 0 | 0 | 20.0 | 0 | 0 |
| Ultraviolet absorber | 1.0 | 1.0 | 1.0 | 1.0 | 1.0 | 0 | 1.0 | 1.0 | 1.0 | 1.0 |

TABLE 2-continued

| Coated golf ball No. | 1 | 2 | 3 | 4 | 5 | 6 | 7 | 8 | 9 | 10 |
|---|---|---|---|---|---|---|---|---|---|---|
| Cover | A | A | B | C | D | E | A | A | A | A |
| Blue pigment | 0 | 0 | 0 | 0 | 0 | 0 | 0 | 0 | 0 | 0.01 |
| Light stabilizer | 0 | 0 | 0 | 0 | 0 | 0 | 2.0 | 0 | 0 | 0 |
| Second paint Layer | | | | | | | | | | |
| Resin | — | — | — | — | — | — | — | urethane | — | — |
| Fluorescent brightener | — | — | — | — | — | — | — | 0.2 | — | — |
| Titanium oxide | — | — | — | — | — | — | — | 0 | — | — |
| Ultraviolet absorber | — | — | — | — | — | — | — | 1.0 | — | — |
| Coated golf ball | | | | | | | | | | |
| L*(after coating) | 91.0 | 90.8 | 87.4 | 88.1 | 85.3 | 91.4 | 87.3 | 88.2 | 87.7 | 88.3 |
| a*(after coating) | −0.2 | −0.4 | 4.8 | 3.3 | −1.9 | 0.2 | 1.1 | 2.7 | 2.8 | −1.5 |
| b*(after coating) | −8.0 | −7.9 | −6.1 | −1.3 | −15.9 | −5.5 | −5.5 | −3.6 | −4.2 | −10.8 |

TABLE 3

| Coated golf ball No. | 1 | 2 | 3 | 4 | 5 | 6 | 7 | 8 | 9 | 10 |
|---|---|---|---|---|---|---|---|---|---|---|
| Ball body | | | | | | | | | | |
| L* (body) | 90.5 | 90.5 | 87.8 | 88.6 | 86.0 | 91.0 | 90.5 | 90.5 | 90.5 | 90.5 |
| a* (body) | −0.5 | −0.5 | 5.0 | 3.0 | −2.3 | 0.5 | −0.5 | −0.5 | −0.5 | −0.5 |
| b* (body) | −7.0 | −7.0 | −5.5 | −2.0 | −15.0 | −7.0 | −7.0 | −7.0 | −7.0 | −7.0 |
| Coated golf ball | | | | | | | | | | |
| L*(after coating) | 91.0 | 90.8 | 87.4 | 88.1 | 85.3 | 91.4 | 87.3 | 88.2 | 87.7 | 88.3 |
| a*(after coating) | −0.2 | −0.4 | 4.8 | 3.3 | −1.9 | 0.2 | 1.1 | 2.7 | 2.8 | −1.5 |
| b*(after coating) | −8.0 | −7.9 | −6.1 | −1.3 | −15.9 | −5.5 | −5.5 | −3.6 | −4.2 | −10.8 |
| Differnce | | | | | | | | | | |
| \| Δ L \| | 0.5 | 0.3 | 0.4 | 0.5 | 0.7 | 0.4 | 3.2 | 2.3 | 2.4 | 2.2 |
| \| Δ a \| | 0.3 | 0.1 | 0.2 | 0.3 | 0.4 | 0.7 | 1.6 | 3.2 | 3.3 | 2.0 |
| \| Δ b \| | 1.0 | 0.9 | 0.6 | 0.7 | 0.9 | 1.5 | 1.6 | 3.4 | 2.8 | 3.8 |
| Evaluation | | | | | | | | | | |
| Appearance | ○ | ○ | x | x | x | ○ | x | x | x | ○ |
| Color fastness to weathering | ○ | ○ | ○ | ○ | ○ | Δ | ○ | x | ○ | x |
| Flaw conspiciousness | ○ | ○ | ○ | ○ | ○ | ○ | x | x | x | x |
| Flaw conspiciousness After UV irradiation | ○ | ○ | ○ | ○ | ○ | x | x | x | x | x |

Any one of coated golf balls Nos. 3 to 5 did not have a satisfactory appearance because the color tone of the ball body thereof was out of the range specified by the present invention.

Coated golf ball No. 10 had a satisfactory brand-new stage appearance because the color tone of its ball body and the color tone after coating as well as the color tone difference between the states before and after coating fell within respective ranges specified by the present invention. However, this ball did not have satisfactory color fastness to weathering because of the paint layer containing a pigment. Further, a flawed portion of this ball became conspicuous because the Δb value was large.

Coated golf ball No. 6 had a satisfactory brand-new stage appearance because the color tone of its ball body and the color tone after coating as well as the color tone difference between the states before and after coating fell within respective ranges specified by the present invention. However, this ball was color-changed during weathering and had a flaw that became conspicuous after weathering because its cover contained a fluorescent brightener and an ultraviolet absorber and its paint layer was free of any ultraviolet absorber.

Coated golf ball No. 9 had a ball body showing a color tone within the range specified by the present invention. However, the color difference between the states of this ball before and after coating was large due to the paint layer free of any fluorescent brightener and, hence, the color tone after paint coating could not fall within the range specified by the present invention. For this reason, the golf ball did not have a satisfactory early stage appearance and had high flaw conspicuousness.

Coated golf ball No. 7 having a clear paint layer containing a light stabilizer had a conspicuous flawed portion due to large "ΔL", "Δa" and "Δb" values. Further, ball No.7 had a poor appearance with inferior transparency due to the paint layer containing the light stabilizer. Furthermore, the ball had inferior color fastness to weathering and, hence, a flawed portion was still conspicuous after UV irradiation.

On the other hand, coated golf balls Nos. 1 and 2 meeting all the requirements of the present invention each had satisfactory early stage appearance and color fastness to weathering. Further, this ball had a flawed portion that was inconspicuous both in its early stage and in its stage after UV irradiation.

Coated golf ball No. 8 had two clear paint layers, wherein the first layer contained a white pigment though the second layer was colorless and transparent and, hence, the difference in color tone between the ball body and the state after coating with the second layer was out of the range specified by the present invention. This ball had an unsatisfactory early stage appearance because the color tone after coating was out of the range specified by the present invention. The flawed portion of the ball in its early stage was conspicuous due to a large difference in color tone between the ball body and the ball after coating. Further, color change occurred during weathering due to the first paint layer containing the pigment and, hence, the flaw conspicuousness after weathering was high.

The coated golf ball of the present invention includes a ball body covered with a colorless, transparent paint layer free of any pigment. By virtue of this paint layer, the color of the ball body adjusted to a bright white tone is shown even after the ball body has been covered with the paint layer and, hence, a flawed portion of the golf ball in its brand-new state does not become conspicuous. Further, even after the ball has been left outdoors for a long time, the color of the ball body is still shown as it is and makes the flaw inconspicuous.

This application is based on Japanese Patent Application Serial No. 2000-325838 filed in Japanese Patent Office on Oct. 25, 2000, the contents of which are hereby incorporated by reference.

While only certain presently preferred embodiments of the present invention have been described in detail, as will be apparent for those skilled in the art, certain changes and modifications may be made in embodiments without departing from the spirit and scope of the present invention as defined by the following claims.

What is claimed is:

1. A coated golf ball comprising a ball body, and at least one colorless, transparent paint layer covering the ball body, the ball body having a surface layer containing a white pigment and essentially free of a fluorescent brightener and an ultraviolet absorber, the paint layer containing a fluorescent brightener and an ultraviolet absorber, wherein:

the color tone represented by CIE L*a*b* color system on a surface of the ball body satisfies the following requirement:

L* being in the range of 88 to 93, a* being in the range of −2 to 2, and b* being in the range of −12 to −5, the color tone represented by CIE L*a*b* color system on a surface of the paint layer formed over the surface of the ball body satisfies the following requirement:

L* being in the range of 88 to 93, a* being in the range of −2 to 2, and b* being in the range of −12 to −5, CIE L*a*b* color difference between the color tone on the surface of the ball body and the color tone on the surface of the paint layer satisfies the following requirement:

a difference (ΔL) in the L* being not more than 2 a difference (Δa) in the a* being not more than 3, and a difference (Δb) in the b* being not more than 3.

2. The coated golf ball according to claim 1, wherein the paint layer is free of a light stabilizer.

3. A method of making a coated golf ball protected against conspicuous enamel defects in peeling of the paint layer on a surface of a ball body with at least one colorless, transparent paint layer covering the ball body, which method comprises forming the ball body having a surface layer containing a white pigment and essentially free of a fluorescent brightener and an ultraviolet absorber, wherein (1) the paint layer contains a fluorescent brightener and is free of a light stabilizer; and (2) the color tone represented by the CIE L*a*b* color system on a surface of the ball body satisfies the following requirement:

L* being in the range of 88 to 93, a* being in the range of −2 to 2, and b* being in the range of −12 to −5; and (3) the color tone represented by CIE L*a*b* color system on a surface of the paint layer formed over the surface of the ball body satisfies the following requirement:

L* being in the range of 88 to 93, a* being in the range of −2 to 2, and b* being in the range of −12 to −5; and the CIE L*a*b* color difference between the color tone on the surface of the ball body and the color tone on the surface of the paint layer satisfies the following requirement:

a difference (ΔL) in the L* being not more than 2, a difference (Δa) in the a* being not more than 3, and a difference (Δb) in the b* being not more than 3, and wherein the content of the fluorescent brightener in the paint layer is 0.005 to 3 parts by mass based on 100 parts by mass of a paint layer forming component, while the paint layer has a thickness of 5 to 100 μm.

4. A method of making a coated golf ball protected against conspicuous enamel defects in peeling of the paint layer on a surface of a ball body with at least one colorless, transparent paint layer covering the ball body, which method comprises forming the ball body having a surface layer containing a white pigment and essentially free of a fluorescent brightener and an ultraviolet absorber, wherein (1) the paint layer contains a fluorescent brightener and an ultraviolet absorber; and (2) the color tone represented by the CIE L*a*b* color system on a surface of the ball body satisfies the following requirement:

L* being in the range of 88 to 93, a* being in the range of −2 to 2, and b* being in the range of −12 to −5; and (3) the color tone represented by CIE L*a*b* color system on a surface of the paint layer formed over the surface of the ball body satisfies the following requirement:

L* being in the range of 88 to 93, a* being in the range of −2 to 2, and b* being in the range of −12 to −5; and the CIE L*a*b* color difference between the color tone on the surface of the ball body and the color tone on the surface of the paint layer satisfies the following requirement:

a difference (ΔL) in the L* being not more than 2, a difference (Δa) in the a* being not more than 3, and a difference (Δb) in the b* being not more than 3, and wherein the content of the fluorescent brightener in the paint layer is 0.005 to 3 parts by mass based on 100 parts by mass of a paint layer forming component, while the paint layer has a thickness of 5 to 100 μm.

* * * * *